United States Patent [19]

Fisher

[11] 4,147,292

[45] Apr. 3, 1979

[54] MAILBOX FLAG DEVICE

[76] Inventor: Baxter Fisher, Rte. 3, Box 285, Springfield, Oreg. 97477

[21] Appl. No.: 859,331

[22] Filed: Dec. 12, 1977

[51] Int. Cl.[2] ..... A47G 29/12

[52] U.S. Cl. ..... 232/35; 232/34

[58] Field of Search ..... 232/35, 34, 17

[56] References Cited

U.S. PATENT DOCUMENTS

| | | | |
|---|---|---|---|
| 1,526,763 | 2/1925 | Schwarz | 232/17 |
| 1,535,677 | 4/1925 | Maserang | 232/35 |
| 1,685,874 | 10/1928 | Feist | 232/35 |
| 1,982,923 | 12/1934 | Nelson | 232/17 X |
| 2,636,669 | 4/1953 | Mossman | 232/35 |
| 2,834,540 | 5/1958 | Hudgins | 232/35 X |
| 3,014,641 | 12/1961 | Sowton | 232/35 |
| 3,080,107 | 3/1963 | Lindahl | 232/35 |

*Primary Examiner*—Francis K. Zugel

*Attorney, Agent, or Firm*—James D. Givnan, Jr.

[57] ABSTRACT

A rural mailbox flag device for attachment to the mailbox by existing fasteners normally serving to secure a frictional latch member to the mailbox. A flag support member includes a horizontal flange with relieved areas which facilitates reception of the latch mounting fasteners. A flag is held upright by mailbox door structure. The flag is automatically repositioned from its upright position upon opening of the mailbox door to provide a signal to the mailbox owner of the visited-non visited status of the box.

1 Claim, 5 Drawing Figures

MAILBOX FLAG DEVICE

BACKGROUND OF INVENTION

The present invention relates generally to rural mailbox flags and particularly to such a flag automatically positioned upon opening the mailbox door without postman effort.

Known in the prior art are various devices for indicating the presence of mail in a mailbox for postal pickup and indicating the delivery or non-delivery of mail to a mailbox by the postman. These devices include various pivotally mounted flag arrangements some of which automatically reposition your door opening.

A drawback to several known prior art devices is their complexity of structure rendering same costly to manufacture and complexity of installation. Further, some mailbox flag devices do not lend themselves to use with all types of box supporting structures, for example, some rural mailboxes are installed on a flat surface such as a horizontal board which supports several mailboxes. The earlier flag devices proposed include appendages which must swing below a plane containing the box lower extremity and which swinging movement is obstructed by the above mentioned horizontal supporting surface. Accordingly, such flag devices are of limited use.

A further drawback to some known flag devices is the added burden to the postman of manipulating the flag device.

SUMMARY OF THE PRESENT INVENTION

The present invention is embodied in a flag device for attachment to a rural mailbox which uses existing, approved components presently used for attaching a mailbox door latch member and, when in place, provides a highly useful, automatically actuated flag for both the postman and the mailbox owner.

The present flag device includes a flag support member adapted for convenient securement to the box using existing mailbox fastener openings. In use today are mailboxes with door and box mounted latch components which rely on frictional interengagement to retain the door closed. The box mounted latch component is located atop the frontal apex of the box and is usually held in place by a pair of fastener assemblies while the door mounted latch component is riveted in place. The present flag support member is insertable into engagement with the mailbox latch component.

The flag of the present device includes a downward extension disposed within the path of door opening movement when the flag is upright. When so positioned, the postman is thereby notified of mail in the box for pickup. The flag is automatically tipped rearwardly past its center of gravity and falls to a horizontal position of rest upon door opening by the postman.

A second form of the invention includes a flag having lower edges configured so as to provide a flag which has an upright position signaling the postman of mail for pickup and inclined-horizontal positions to signal the box owner, by dropping to the horizontal, that the postman has stopped at the box. These lower flag edges cooperate with a door mounted clip which, upon door opening, permits the flag to gravitate toward a lower position.

Important objects of the present invention include; the provision of a mailbox flag device utilizing fasteners or at least fastener openings already on the mailbox and thereby not conflicting with the Postal Service approved status of the mailbox; the provision of a mailbox flag device which provides multiple signals without requiring the manipulation of the flag by the postman; the provision of a mailbox flag which is of low cost construction and reliable operation and one easily installed by the box owner without box alteration, and; provision of a rural mailbox flag device capable of use on all mailboxes and providing a signal that the postman has called at the box.

DETAILED DESCRIPTION OF THE PREFERRED EMBODIMENTS

Figure 1:
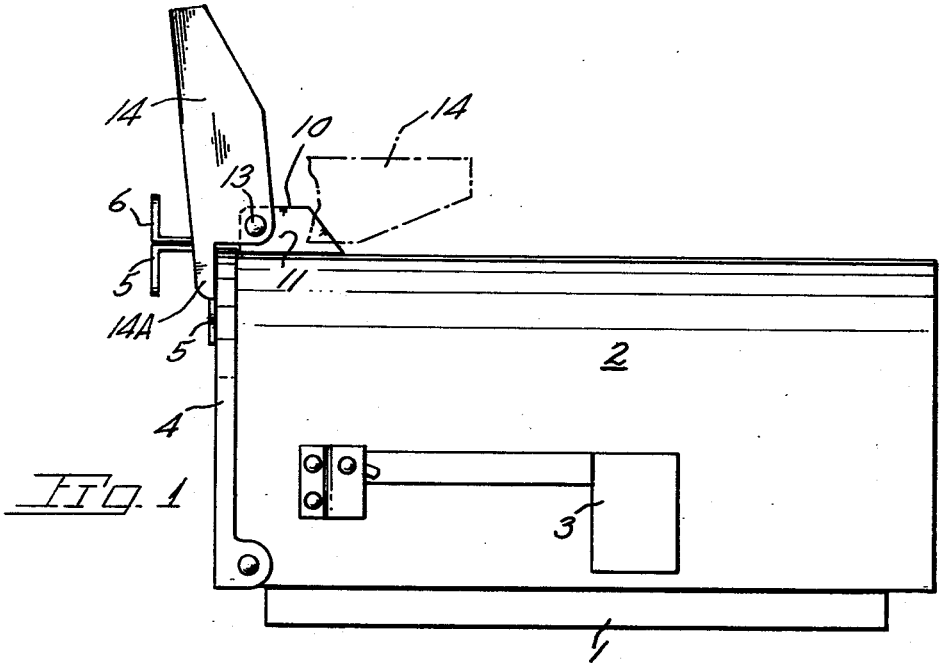
FIG. 1 is a side elevational view of a mailbox with the present invention in place thereon.
Figure 2:
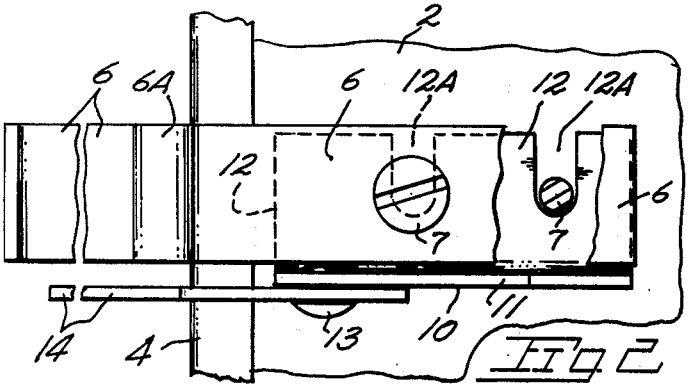
FIG. 2 is a fragmentary plan view of FIG. 1.

In the accompanying drawing, the reference numeral 1 indicates a box support structure on which may be located one or more mailboxes of the rural type. Typically mailboxes are often grouped on a horizontal support 1. The mailbox indicated at 2 is of the type in wide use throughout the United States of America. Desirably modifications to an approved box are such as to not affect the approved box status or incur objections from postal authorities. A conventional box mounted flag is indicated at 3 while door structure is indicated at 4. The door carries a friction type latch member 5 while a cooperating latch member is shown at 6 and is mounted to the apex of the box by fasteners 7. The structure above described is conventional.

The device embodying the present invention includes a flag support member 10 of angular configuration having a first upright flange 11 and a second or horizontal flange 12. Flange 11 carries a pivotal connection such as a rivet 13 on which is swingably mounted a metal flag 14.

With attention to flag support member 10, flange 12 thereof is adapted for securement to the box apex by fasteners 7 which additionally serve to secure latch member 6 to the mailbox. Flange 12 is relieved which may be in the form of slotted areas 12A to enable inserted passage of flange 12 past the fastener shanks. Any repositioning of latch member 6 by insertion of flange 12 therebelow may be compensated for by slight downward bending of the latch member. The latch members 5 and 6 conventionally include curved segments as at 6A to assure frictional interengagement.

Flag 14 includes a depending finger or extension 14A which, with the flag raised per FIG. 1, rests against the outer surface of door structure 4. Opening of the door by the postmen automatically moves flag 14 rearwardly past its center of gravity whereat it falls to a position of rest atop the box to signal the box owner the postman has called at the box.

Figure 3:
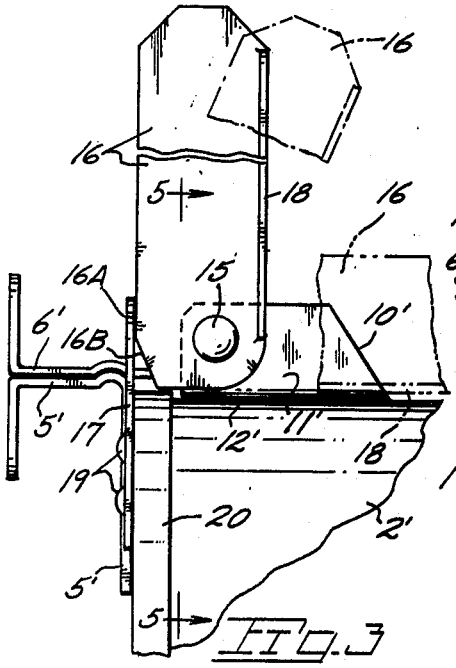
FIG. 3 is a fragmentary side elevational view of a mailbox with a modified form of flag device thereon.
Figure 4:
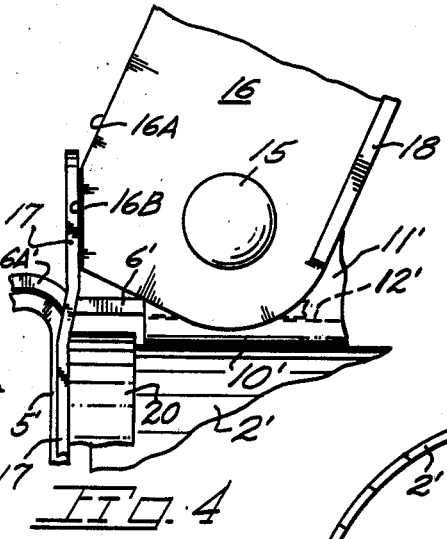
FIG. 4 is a view similar to FIG. 3 but on a greater scale and with the flag positioned in an inclined position.
Figure 5:
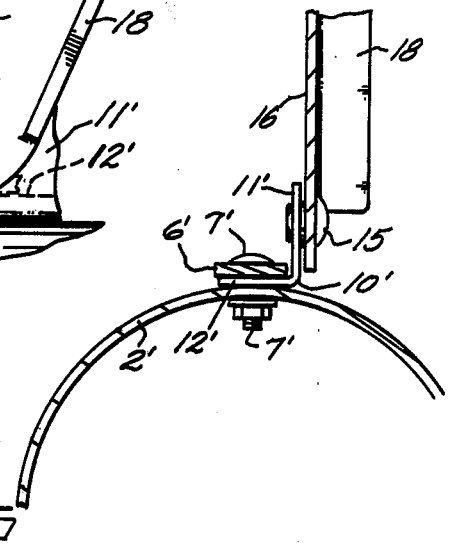
FIG. 5 is a sectional view taken along line 5—5 of FIG. 3.

With attention to FIGS. 3, 4 and 5 wherein a modified form of the invention is disclosed, a flag support member 10' includes an upright flange 11' and a horizontal flange 12' as above described. Horizontal flange 12′ is relieved to permit its securement in the above set forth manner by fasteners 7′ extending also through a latch member 6′. Additional mailbox structure is identified with prime reference numerals corresponding to the parts and like reference numerals used above.

The modified feature resides in a flag at 16 and a flag retainer clip at 17. Flag 16 is swingably mounted at its lower end to flange 11′ by pivot means 15. Said flag is provided with first and second angularly related lower edges at 16A and 16B which cooperate with the door mounted retainer clip 17 on door structure 20 to retain the flag in both upright and inclined positions as shown in FIGS. 3 and 4. With door 20 closed, the flag is held at either of the preset positions. Flag 16 is weighted such as by a flange 18 along its rearward edge so as to have a center of gravity rearward of the pivot 15 whereby opening of door structure 20 will permit the flag to fall to the horizontal rest (double dot broken line) position of FIG. 3. Retainer clip 17 on door structure 20 may be of an yieldable nature to permit flag positioning by the box owner while door 20 remains closed. Fasteners at 19 secure retainer clip 17 to door 20.

Operation of the first described form of the invention is believed obvious.

In operation of the modified form of the invention, the box owner may position the flag 16 vertically to signal the postman pickup mail is in the box. The inclined flag position (FIG. 4) may be used by the box owner as a signal to himself that mail has been delivered to the box as, for example, when flag 16 has fallen from the inclined position to the horizontal position. In any case, the postman is not required to manipulate the present flag device as is the case with existing mailbox flags.

The installation of the present flag device requires but a few minutes effort with screwdriver and pliers as the existing fasteners may be used in some instances or at least existing fastener openings in the box and latch member. To assure desired freedom of movement of flags 14 and 16, the pivot means 13 and 15 may be provided with suitable friction reducing washers.

While I have shown but a few embodiments of the invention it will be apparent to those skilled in the art that the invention may be embodied still otherwise without departing from the spirit and scope of the invention.

Having thus described the invention, what is claimed and desired to be secured under a Letters Patent is:

1. A flag device for attachment to a rural mailbox of the type having cooperating latch members on the mailbox and mailbox door structure, said device comprising, a flag having vertical, inclined and horizontal positions indicating respectively the presence of mail in the mailbox for pickup, the non visited and visited status of the mailbox, a clip attached to the door structure, a flag support member including first and second flanges, pivot means on said first flange supporting said flag for arcuate travel between vertical and horizontal positions, said second flange defining relieved areas enabling securement to the mailbox by those fasteners securing one of the latch members to the mailbox, and said flag having a first lower edge for supported contact with the mailbox door mounted clip to hold the flag in a vertical position, said flag having a second lower edge for alternate contact with the mailbox door mounted clip, said second lower edge in angular relationship to said first edge and thereby adapted to hold the flag in a manually preset inclined position when there is no pickup mail in the mailbox, said flag dropping to a horizontal position from its inclined position upon opening of the mailbox door structure to indicate the visited status of the mailbox.

* * * * *